US007900378B1

(12) United States Patent
Busse

(10) Patent No.: US 7,900,378 B1
(45) Date of Patent: Mar. 8, 2011

(54) LOW PROFILE DEFLATION MECHANISM FOR AN INFLATABLE BLADDER

(75) Inventor: Mark Busse, Providence, RI (US)

(73) Assignee: Reebok International Ltd., Canton, MA (US)

( * ) Notice: Subject to any disclaimer, the term of this patent is extended or adjusted under 35 U.S.C. 154(b) by 1228 days.

(21) Appl. No.: 11/475,254

(22) Filed: Jun. 27, 2006

(51) Int. Cl.
*A43B 13/20* (2006.01)

(52) U.S. Cl. ..... 36/29; 36/3 B

(58) Field of Classification Search ..... 36/28, 29, 36/37, 35 B, 3 B, 3 R
See application file for complete search history.

(56) References Cited

U.S. PATENT DOCUMENTS

| | | | | |
|---|---|---|---|---|
| 3,060,956 | A | 10/1962 | Taggart | |
| 3,454,033 | A | 7/1969 | Smith | |
| 3,976,096 | A | 8/1976 | Kass | |
| 4,446,634 | A * | 5/1984 | Johnson et al. | 36/29 |
| 4,742,844 | A | 5/1988 | Szlaga | |
| 5,253,435 | A * | 10/1993 | Auger et al. | 36/88 |
| 5,379,531 | A * | 1/1995 | Iwama | 36/117.7 |
| 5,794,361 | A * | 8/1998 | Sadler | 36/29 |
| 6,195,914 | B1 | 3/2001 | Otis | |
| 6,725,573 | B2 * | 4/2004 | Doyle | 36/29 |
| 7,082,967 | B2 | 8/2006 | Sarajian et al. | |
| 7,152,625 | B2 | 12/2006 | Marvin et al. | |
| 2003/0204968 | A1 * | 11/2003 | Liu | 36/50.1 |

* cited by examiner

*Primary Examiner* — Jila M Mohandesi
(74) *Attorney, Agent, or Firm* — Sterne, Kessler, Goldstein & Fox P.L.L.C.

(57) ABSTRACT

An article of footwear includes a movable knob and a lever coupled to the knob. The movable knob is accessible from an exterior surface of the article of footwear and has a substantially low profile with respect to the exterior surface of the article of footwear. The lever has a first position in which the lever lays flat against the knob and a second position wherein the lever is positioned for a user to move the knob via the lever. In one embodiment, an article of footwear also includes an inflatable bladder, an inflation mechanism and a deflation mechanism. The knob is part of a deflation mechanism including a cap and a base, wherein the base is anchored to the inflatable bladder and the cap is rotatable with respect to the base. In another embodiment, an article of footwear includes a movable knob accessible from an exterior surface of the article of footwear and an apron substantially surrounding the movable knob. The apron includes ramped sides and provides a substantially low profile to the knob with respect to the exterior surface of the article of footwear. The apron may be temporarily removed from the knob such that a user may access the knob.

15 Claims, 9 Drawing Sheets

LOW PROFILE DEFLATION MECHANISM FOR AN INFLATABLE BLADDER

FIELD OF THE INVENTION

The present invention relates generally to a low profile deflation mechanism for use with an inflatable bladder, preferably an inflatable bladder for an article of footwear.

BACKGROUND OF THE INVENTION

Fit, comfort and cushioning are desired features in footwear. Inflatable bladders have been used in articles of footwear, or shoes, to provide improved fit and cushioning for better comfort. The inflatable bladder may form part of either the shoe upper or the sole of a shoe and may be inflated by a variety of inflation mechanisms, including a detachable inflation device, an on-board inflation device, an automatic underfoot inflation device, etc.

One goal in developing inflatable bladders for shoes has been to control the volume and pressure of air within the bladder. Too little air or too little air pressure within an inflatable bladder may not provide sufficient fit and/or cushioning to the shoe, such that the shoe may be loose or may not provide adequate cushioning. Too much air or too high of air pressure within an inflatable bladder may cause the bladder to pinch or exert painful pressure to areas of the foot during athletic activity. Thus, various deflation mechanisms and pressure regulators have been provided to control the air pressure within the inflatable bladder.

U.S. Pat. No. 6,785,985 and Published U.S. Patent Application Numbers 2004/0003517 and 2005/0028404, each of which is incorporated by reference herein in its entirety, describe, inter alia, various deflation mechanisms for controlling the amount of air within an inflatable bladder.

Another goal in shoe design is to provide an article of footwear with a low profile. As such, large and cumbersome features extending from an exterior surface of a shoe add weight to the shoe and are generally less aesthetically pleasing to the eye. Further, extending features may become hit, brushed against or damaged and may be hazardous to other participants during athletic activity, for example contact sports.

Another goal in designing shoe parts is ease of use. Inflation or deflation mechanisms which are difficult to use are not desirable.

BRIEF SUMMARY OF THE INVENTION

The present invention provides low profile and easy to use knobs for an article of footwear.

One embodiment of the present invention is an article of footwear including a movable knob and a lever coupled to the knob. The movable knob is accessible from an exterior surface of the article of footwear and has a substantially low profile with respect to the exterior surface of the article of footwear. The lever has a first position in which the lever lays flat against the knob and a second position wherein the lever is positioned for a user to move the knob via the lever. When not in use assisting with the movement of a knob, the lever lays flat against the knob maintaining a low profile with respect to the exterior of the article of footwear.

Another embodiment of the present invention is an article of footwear including an inflatable bladder, an inflation mechanism fluidly connected to the inflatable bladder and a deflation mechanism fluidly connected to the inflatable bladder. The deflation mechanism includes a cap and a base, in which the cap is rotatable with respect to the base. The cap includes a lever that has a first position in which the lever lays flat against an upper surface of the cap and a second position wherein the lever extends perpendicular from the upper surface of said cap. The lever is hingedly moveable between the first and second positions.

In another embodiment of the present invention, an article of footwear includes a movable knob accessible from an exterior surface of the article of footwear and an apron substantially surrounding the movable knob. The apron includes ramped sides and provides a substantially low profile to the knob with respect to the exterior surface of the article of footwear. The apron effectively reduces the profile of the deflation mechanism to protect the deflation mechanism during athletic activities.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

FIG. 1A is a perspective view of an embodiment of the present invention positioned on an article of footwear with the lever in the "down" position. FIG. 1B is a perspective view of the embodiment of FIG. 1A with the lever in the "up" position.

FIG. 2A is a perspective view of an embodiment of a valve of the present invention with the lever in the "down" position. FIG. 2B is a perspective view of the embodiment of FIG. 2A with the lever in the "up" position. FIG. 2C is a top view of the embodiment of FIG. 2A.

Figure 5A:
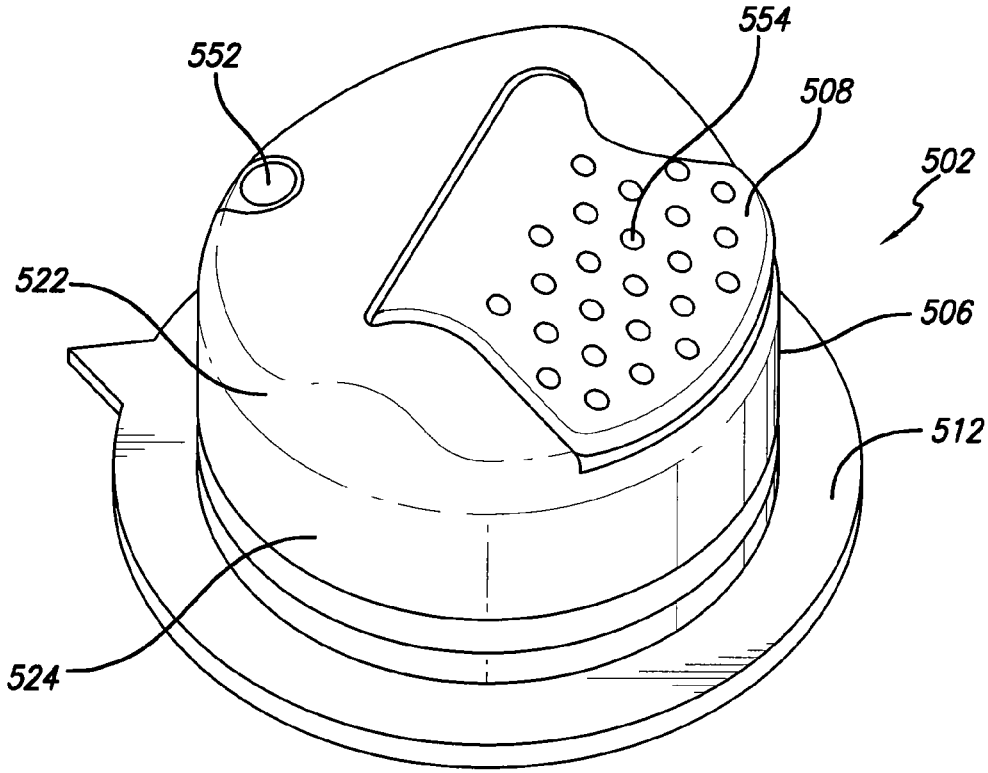
Figure 5B:
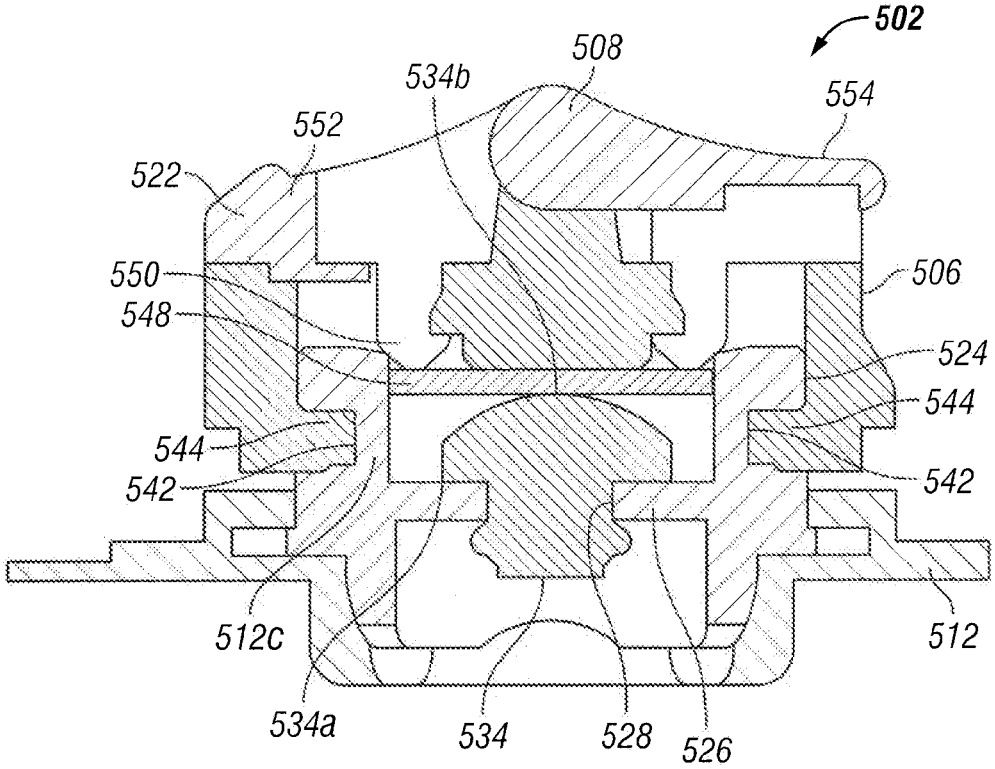
Figure 5C:
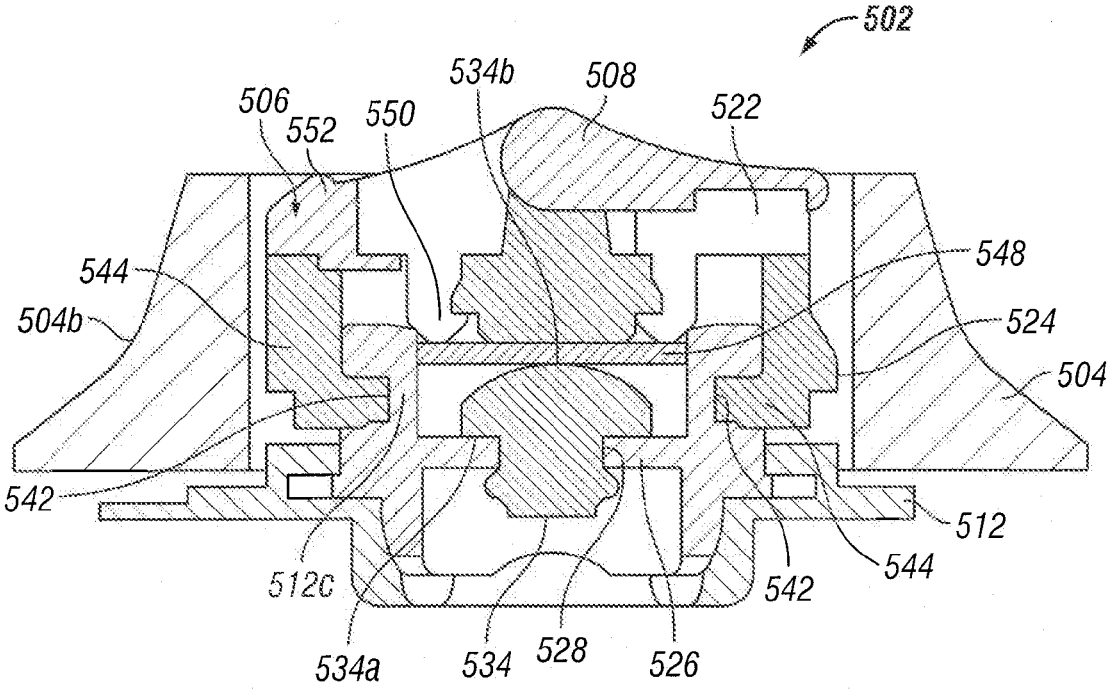

FIG. 5A is a perspective view of an embodiment of a valve of the present invention. FIG. 5B is a sectional view of the valve of FIG. 5A. FIG. 5C is a sectional view of an embodiment of a valve of the present invention.

Figure 6A:
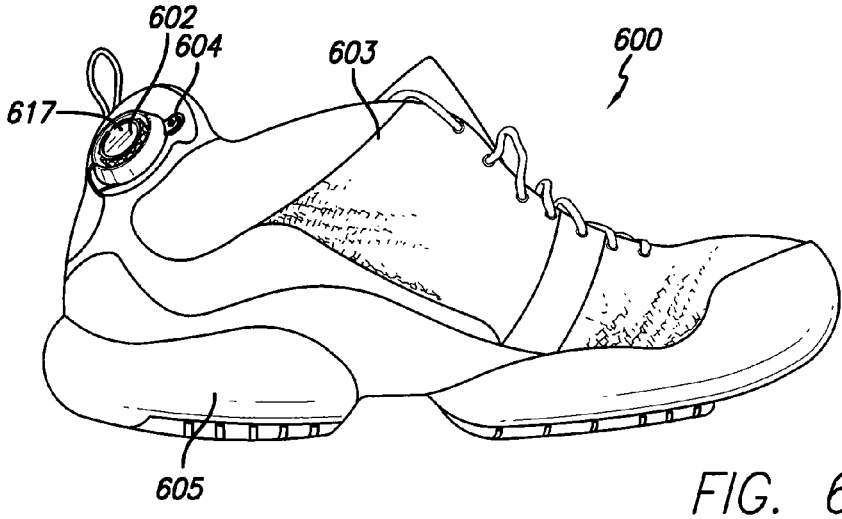
Figure 6B:
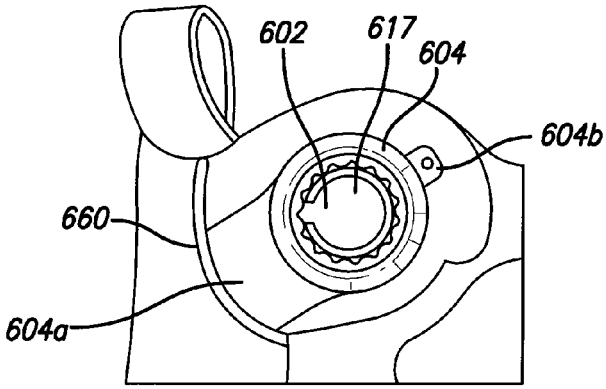
Figure 6C:
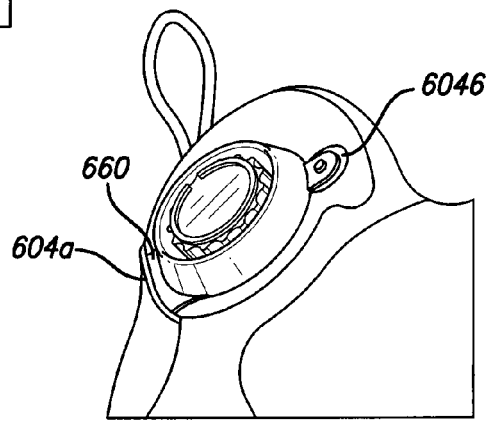
Figure 6D:
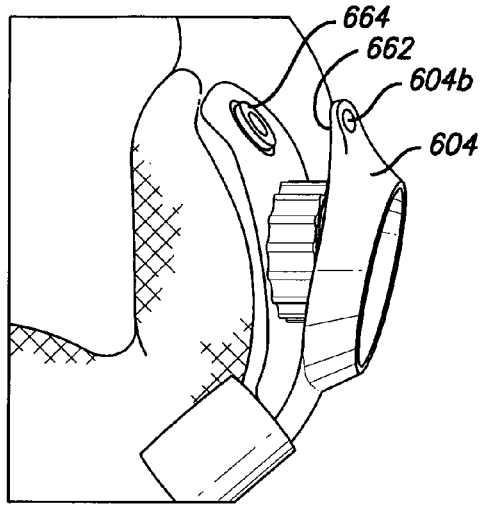
Figure 6E:
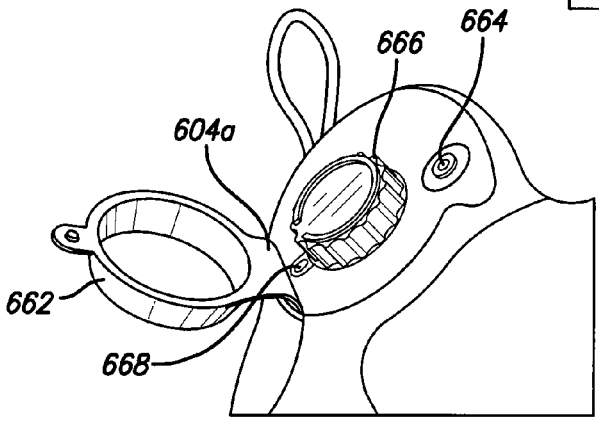
Figure 6F:
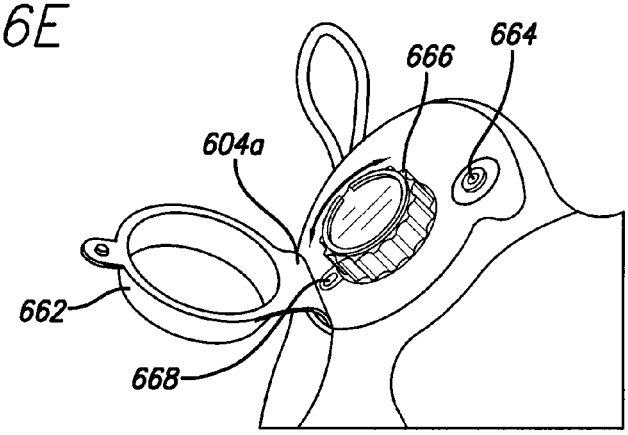

FIG. 6A is a side view of an alternative embodiment of an article of footwear of the present invention. FIG. 6B is a side view of an embodiment of a valve of the present invention. FIG. 6C is a perspective view of the valve of FIG. 6B. FIG. 6D is a top view of the valve of FIG. 6B. FIG. 6E is a side view of the valve of FIG. 6B in an open position. FIG. 6F is a side view of the valve of FIG. 6B in an open position wherein the valve is at a different setting.

The present invention will be described with reference to the accompanying drawings. The drawing in which an element first appears is typically indicated by the leftmost digit(s) in the corresponding reference number.

DETAILED DESCRIPTION OF THE INVENTION

The present invention is directed to a deflation mechanism for an inflatable bladder having a low profile. Preferably, the present invention provides a low profile deflation mechanism that is particularly useful for an inflatable bladder of an article of footwear.

Figure 1A:
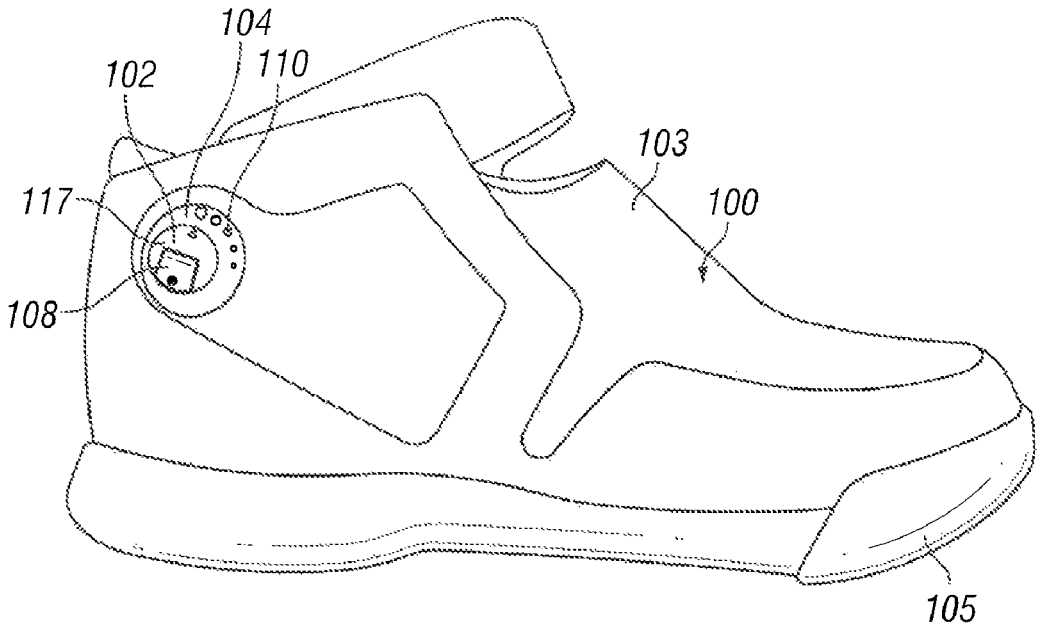
Figure 1B:
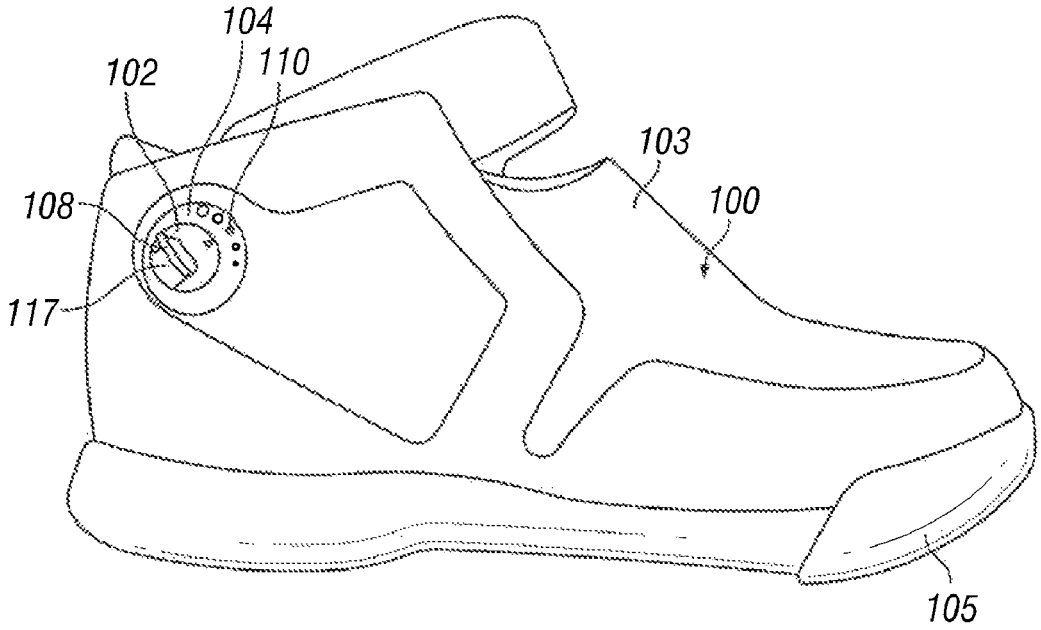

FIGS. 1A and 1B illustrate such an article of footwear, or shoe 100. Shoe 100 includes an inflatable bladder (not shown). A variety of inflatable bladders may be utilized in the present invention. For example, any of the inflatable bladders described in U.S. Pat. No. 6,785,985 and Published U.S. Patent Application Numbers 2004/0003517 and 2005/0028404 may be suitable for use in a shoe of the present invention. One skilled in the art can appreciate that the type of inflatable bladder for use in the present invention is not limited. One example of an inflatable bladder includes two sheets of sealable thermoplastic material through which air may not readily pass. These sheets are sealed around a periphery to form an inflatable bladder. The inflatable bladder preferably includes an inflation mechanism 700 (see FIG. 3A) and a deflation mechanism fluidly connected thereto to customize the pressure and air volume within the inflatable bladder. The present invention is particularly suited for an on-board underfoot inflation mechanism that is operated by the downward pressure of a wearer's foot. Such an inflation mechanism constantly forces air pressure into the inflatable bladder, and thus the inflatable bladder may become too pressurize and uncomfortable. A preferred deflation mechanism is one that maintains a consistent pressure within the inflatable bladder, and more preferably is adjustable.

Shoe 100 includes a knob 102. Shoe 100 further includes an apron 104, also referred to as a berm, that surrounds knob 102. Apron 104 has a gradually ramped sidewall that provides a low profile and protects knob 102, such that it will not get knocked, brushed or damaged during athletic activity. Knob 102 may be moved, for example by turning. However, given the low profile of knob 102, that for example is created by apron 104, it will be difficult to access the knob 102 to move it. One solution to this problem is to have apron 104 be temporarily removable from knob 102, such as being flipped away from knob 102 as discussed below with respect to FIGS. 6A-6F. Another solution is to have knob 102 provided with a lever 108. Lever 108 is illustrated in FIG. 1A in a "down" position, such that when not in use the lever contributes to the low profile of the knob 102. In the "down" position, lever 108 is generally flat against or adjacent to an upper surface 117 of knob 102. FIG. 1B, however, illustrates how lever 108 may be raised to an "up" position, such that a user may grasp lever 108 to move knob 102. In the "up" position, lever 108 is generally perpendicular to or extends from upper surface 117 of knob 102. Further, apron 104 may provide a location for indicators 110. Since knob 102 moves with respect to apron 104, indicators on apron 104 identify the amount that the cap has been turned.

Knob 102 may be found on any part of an article of footwear, for example anywhere on a sole 105 or upper 103 of shoe 100.

In an alternative embodiment, knob 102 may have a profile for other reasons. For example, knob 102 may be flush with an exterior surface of shoe 100, such that an apron 104 is not necessary. In this case, in order to move knob 102, lever 108 must be moved to the "up" position. Alternatively, apron 104 may be replaced or covered by upper or sole material adjacent to knob 102 to provide the desired low profile. Sole or upper material may be foam padding or other cushioning material to further protect the area around knob 102.

In an alternative embodiment, knob 102 may turn, slide, be removable or function in another manner apparent to one skilled in the art such that a low profile may make it difficult to move knob 102. As such, a lever 108 coupled to knob 102 provides for ease of movement of knob 102 and folds to a "down" position to maintain the low profile of knob 102.

Figure 2A:
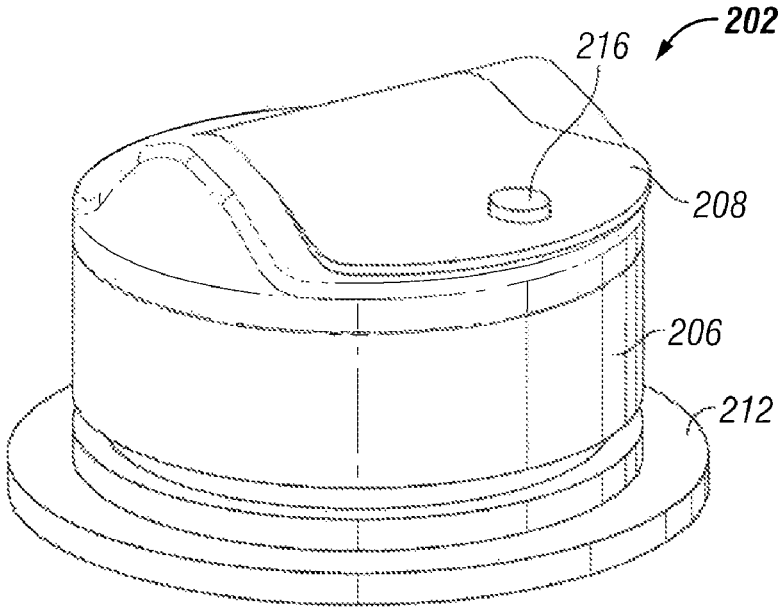
Figure 2B:
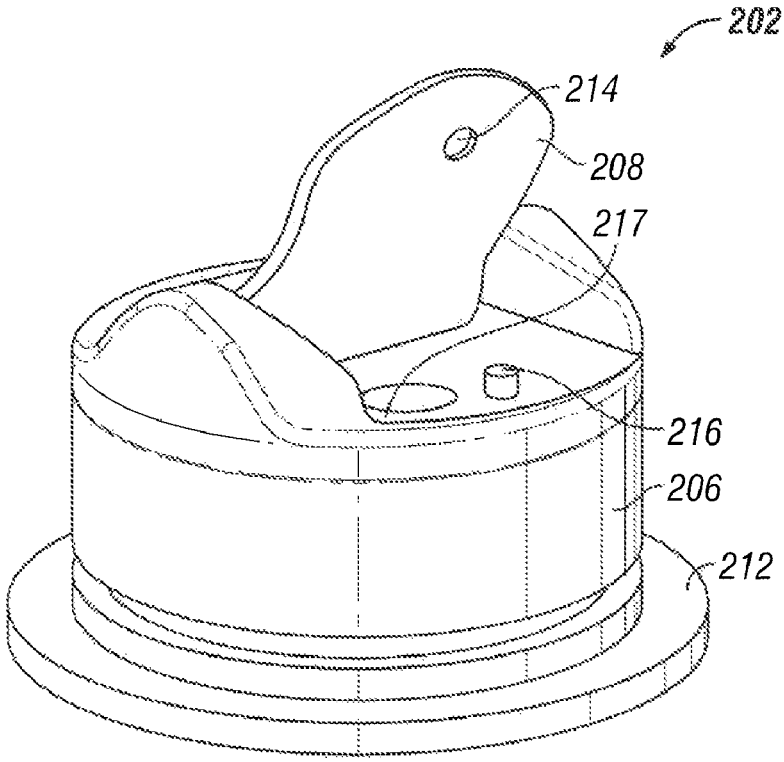
Figure 2C:
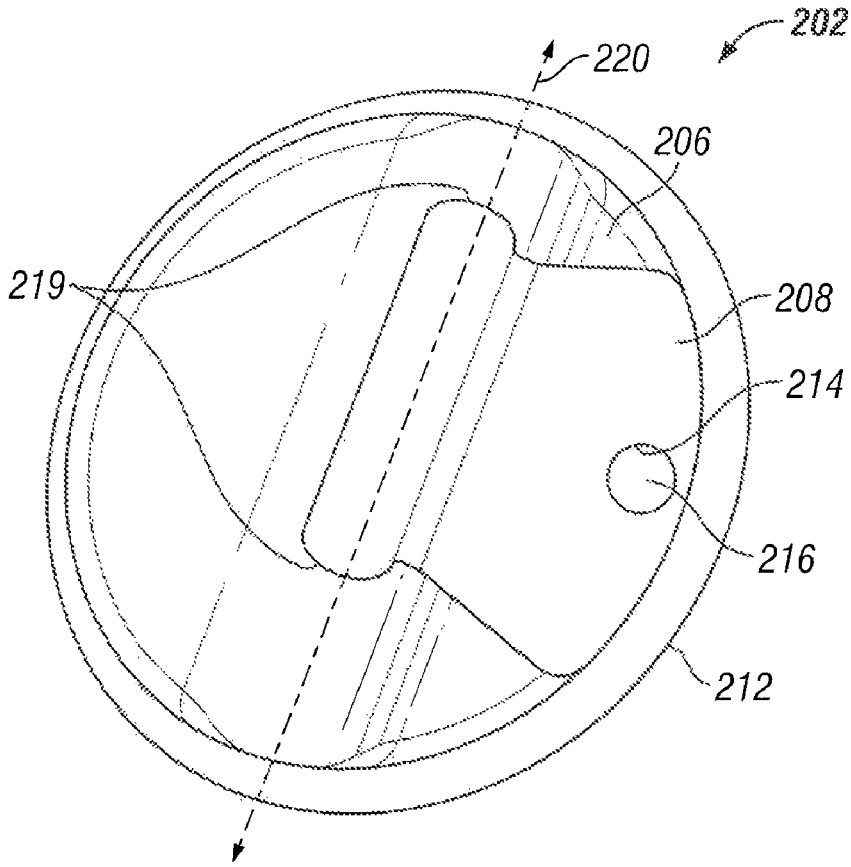

A deflation mechanism 202 is illustrated in FIGS. 2A-2C. Deflation mechanism 202 includes a base 212, a cap 206, which rotates with respect to base 212, and a lever 208. Thus, cap 206 functions as a movable knob. In the present invention, lever 208 includes a hole 214 which engages a pin 216 extending from an upper surface 217 of cap 206 when lever 208 is in a "down" position. As illustrated below, cap 206 is snap fit onto base 212. Similarly, lever 208 includes first and second prongs (not shown) that fit into recesses in cap 206 generally at areas 219 to allow for hinged movement of lever 208 about an axis, which is schematically illustrated as axis 220 in FIG. 2C. FIGS. 2A and 2B illustrate this hinged movement.

Each of cap 206, base 212 and lever 208 may be separately molded pieces. Preferably, cap 206 and/or lever 208 may be made of a durable plastic material. Base 212 may be made of a similar durable plastic material, or it may be made of a sturdy but more flexible plastic material so as to flex along with any flexible material that comprises the shoe, for example the material that comprises the upper of the shoe. An apron, such as apron 104 of FIGS. 1A and 1B, may be used with deflation mechanism 202 and may be made of a similar durable plastic material to that of cap 206 and/or lever 208. Lower costs make injection molded parts preferable. However, lever 208, cap 206, base 212 and apron 104 may be made from metal, such as die-cast aluminum, hardened foam or any other material that would be apparent to one skilled in the art.

Figure 3A:
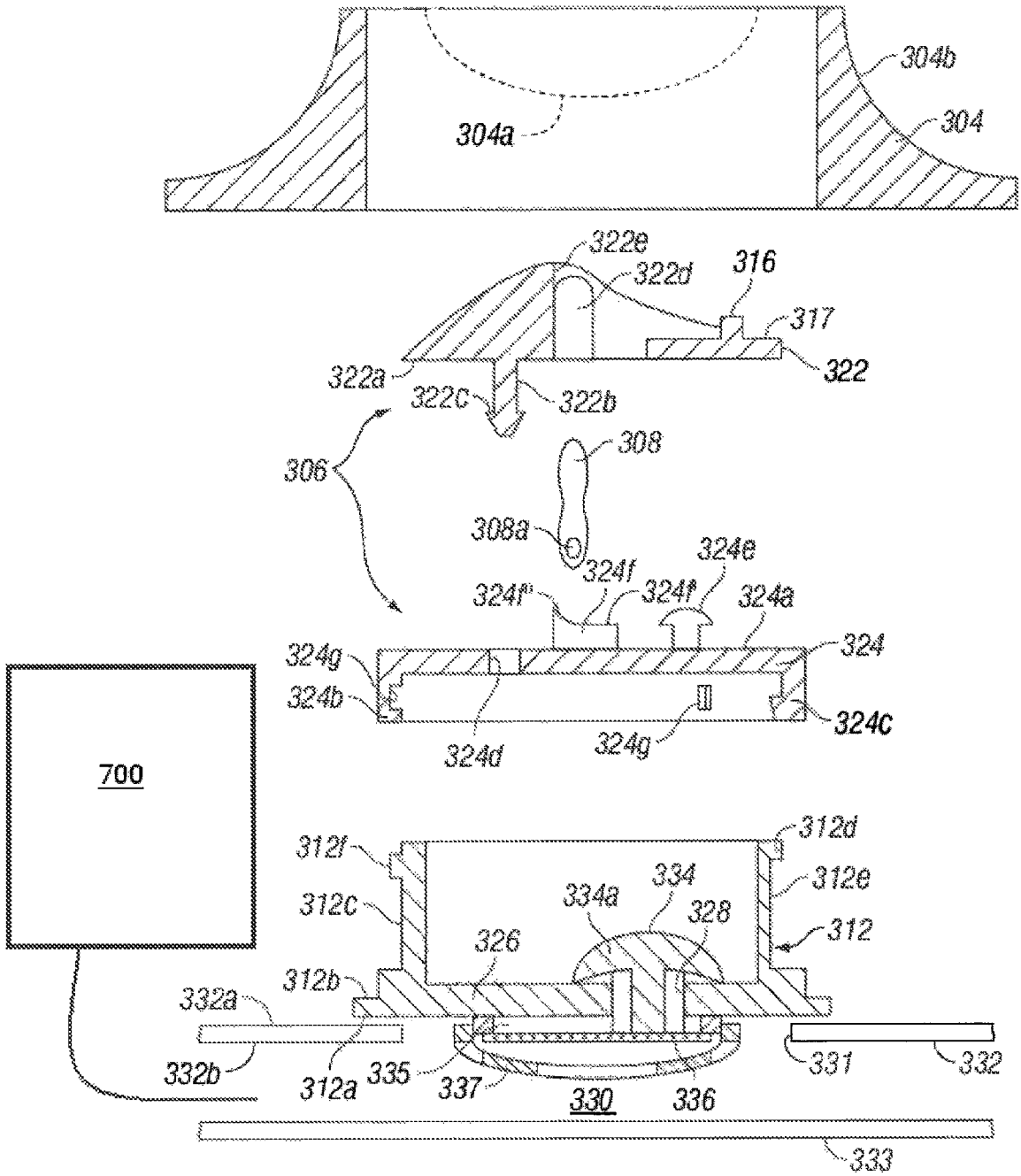
FIG. 3A is a schematic exploded sectional view of the components of an embodiment of a valve of the present invention.

FIG. 3A is a schematic exploded view of components of a deflation mechanism 302 of the present invention. Deflation mechanism 302 includes an apron 304, a lever 308, an upper cap piece 322, a lower cap piece 324 and a base 312. Upper cap piece 322 and lower cap piece 324 fit together to form a cap 306 which rotates with respect to base 312. In other embodiments, however, upper cap piece 322 may be formed with lower cap piece 324 in a single piece.

Deflation mechanism 302 is fluidly connected to an inflatable bladder 330 comprising a first sheet 332 and a second sheet 333 of material that is generally fluid impervious, such as a thermoplastic or other material conventionally used to form inflatable bladders for articles of footwear. Base 312 includes a seating 326 having an inlet 328 therein. Inlet 328 is fluidly connected to inflatable bladder 330 via a hole 331 in first sheet 332. A lower surface 312*a* of base 312 may be sealed to an upper surface 332*a* of first sheet 332, for example, by gluing, bonding, radio frequency (RF) welding, heat welding, ultrasonic welding, or another other method known to one skilled in the art. Alternatively, an upper surface 312*b* of base 312 may be sealed to a lower surface 332*b* of sheet 322, such that a substantial portion of base 312 extends through hole 331 in first sheet 332.

Figure 3B:
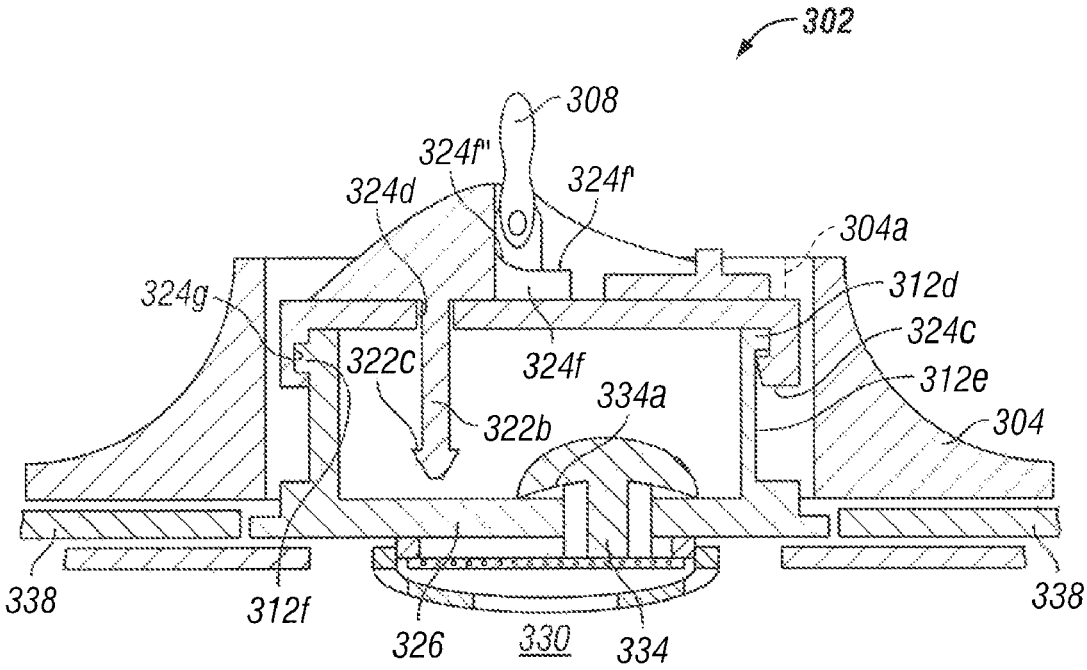
FIG. 3B is a schematic sectional view of the components of FIG. 3A.

A one-way valve 334 is seated in inlet 328 to limit the flow of air from inflatable bladder 330 to the environment. In the example of FIGS. 3A and 3B, one-way valve 334 is an umbrella valve, such as the type typically available from Vernay Laboratories, Yellow Springs, Ohio. One-way valve 334 includes a flange 334*a* which forms a seal with seating 326. When the pressure within bladder causes the pressure under flange 334*a* to reach a predetermined pressure, flange 334*a* lifts off of seating 326 allowing air to escape from inflatable bladder.

Extending from lower surface 312*a* of base 312 is a ring 335 having a wavy exterior surface. Ring 335 prevents second sheet 333 of inflatable bladder 330 from collapsing against inlet 328, which would cause one-way valve 334 to cease operating properly. Ring 335 also provides an optional filter 336 to be positioned adjacent one-way valve 334 by having a filter cover 337 press fit against ring 335. Filter cover 337 holds filter 336 in place. Filter 336 stops impurities within bladder 330 from getting under flange 334*a* and inhibiting the seal between flange 334*a* and seating 326.

Base 312 also includes a generally cylindrical wall 312*c*. A portion of wall 312*c* includes a shoulder 312*d* that defines a channel 312*e*. Shoulder 312*d* is provided to ensure cap 306 is securely fitted with base 312. Channel 312*e* is provided as a track for the rotational movement of cap 306 with respect to base 312. Base 312 also includes a projection 312*f* which temporarily snaps into notches on cap 306 to let the user know when the rotation of cap 306 has reached its limits.

Lower cap piece 324 includes an upper wall 324*a* and a generally cylindrical sidewall 324*b* extending from upper wall 324*a*. Sidewall 324 includes at least one extended edge 324*c*. As illustrated in FIG. 3B, extended edge 324*c* locks over shoulder 312*d* of base 312 to keep cap 306 and base 312 together. Extended edge 324*c* also slides within channel 312*e* allowing cap 306 to rotate with respect to base 312. Lower cap piece 324 also includes notches 324*g* which engage projection 312*f* of base 312 as cap 306 rotates with respect to base 312.

Upper wall 324*a* includes an opening 324*d* and a mushroom-shaped protrusion 324*e*, each of which allows lower cap piece 324 to snap fit and lock with upper cap piece 322, as discussed in detail below. Upper wall 324*a* also includes a curved extension 324*f*. Curved extension 324*f* has a flat side 324*f* and a curved side 324*f*". As illustrated in FIG. 3B, curved extension 324*f* is a seat for lever 308. The curved side 324*f*" of curved extension 324*f* cradles lever 308 and the flat side 324*f* allows lever 308 to lie flat when in a "down" position.

Upper cap piece 322 has a lower surface 322*a* from which extends a cylindrical projection 322*b*. Projection 322*b* includes a shoulder 322*c*. As shown in FIG. 3B, projection 322*b* extends through opening 324*d* in lower cap piece 324. Also, upper cap piece 322 has a hole (not shown) through which mushroom-shaped protrusion 324*e* of lower cap piece 324 extends when lower cap piece 324 and upper cap piece 322 are placed together. The head of mushroom-shaped protrusion 324*e* and the shoulder 322*c* of projection 322*b* ensure that, once snapped together, lower cap piece 324 and upper cap piece 322 will not be separated. Additionally, upper cap piece 324 and lower cap piece 322 may be affixed by gluing, bonding or another method apparent to one skilled in the art.

Upper cap piece 322 includes two recesses 322*d* which engage prongs 308*a* extending from opposite sides of lever 308. Lever 308 is hingedly movable about prongs 308*a* from the "down" position to the "up" position. A wall 322*e* in upper cap piece 322 is provided to give lever 308 something to push against to turn cap 306. Additionally, wall 322*e* keeps lever 308 extended when in an "up" position so that lever 308 does not fall flat in two directions. Upper cap piece 322 also includes a pin 316 extending from an upper surface 317 of cap 306. Pin 316 engages a hole, such as hole 214, in lever 308 when lever 308 is in a "down" position.

As shown in FIG. 3A, apron 304 is cylindrical-shaped with a ramped sidewall 304*b*. Indicators, such as indicators 110, may be printed or otherwise provided on the surface of ramped sidewalls 304*b*. In an optional embodiment, apron 304 may have a cut out section 304*a* (illustrated in phantom) which may be provided to help the user access lever 308 in its "down" position. As illustrated in FIG. 3B, apron 304 surrounds deflation mechanism 302.

FIG. 3B shows the construction of apron 304 and deflation mechanism 302. Although optional, FIG. 3B includes, for illustrative purposes only, additional upper or sole material 338 positioned between inflatable bladder 330 and apron 304. In other embodiments, additional material 338 may be sewn, sealed or otherwise fixedly attached to a first sheet 332 or second sheet 333 of inflatable bladder 330, to upper or lower surfaces 312*a* or 312*b* of base 312 or to apron 304. Material 338 may be for cushioning and comfort, such as foam padding or midsole material, or it may be exterior upper material. Similarly, first sheet 332 may be formed from a laminate of a plastic material and a substrate.

Deflation mechanism 302 functions by rotating cap 306 from an "auto" position, as shown in FIG. 3B, to an "off" position. In the "auto" position, one-way valve 334 is allowed to selectively release air from inflatable bladder 330 when the pressure reaches a predetermined pressure. In the "off" position (not shown), cap 306 is rotated such that projection 322*b* contacts and temporarily deforms flange 334*a* of one-way valve 334 breaking the seal formed with seating 326 and allowing air to exit inflatable bladder 330. In the "off" position, inflatable bladder does not inflate. In the example of FIGS. 3A and 3B, notches 324*g* engage protrusion 312*f* when the cap 306 is rotated to the "auto" position and to the "off" position.

Figure 4:
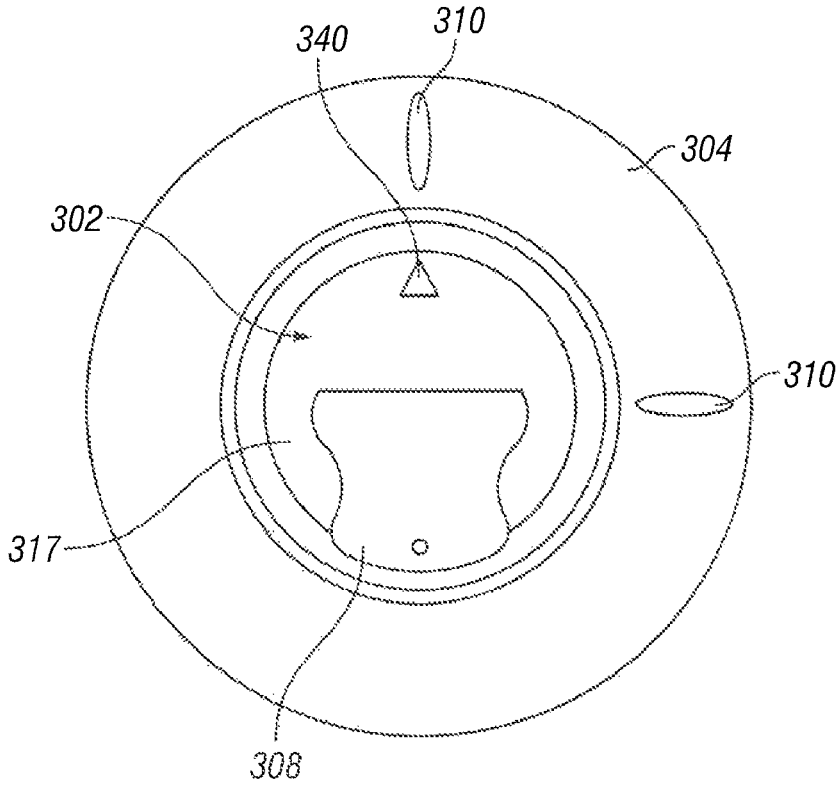
FIG. 4 is a schematic top view of an embodiment of a valve of the present invention.

FIG. 4 provides a top view of deflation mechanism 302 and apron 304, with lever 308 in the "down" position. Notches 324*g* and protrusion 312*f* let the user know the "auto" and "off" positions by feeling the cap 306 snap into position. Further, indicators 310 are printed or otherwise provided on apron 304 and a mark 340 on the upper surface 317 of cap 306 alert the wearer as to the amount of rotation of cap 306 with respect to base 312 and as to the "auto" and "off" positions of deflation mechanism 302.

A lower profile deflation mechanism of the present invention need not be limited to an "auto"/"off" deflation mechanism, such as deflation mechanism 302 described above. A variety of deflation mechanisms may have a reduced profile by incorporating a lever, such as lever 308 discussed above and/or an apron, such as that previously described. FIGS. 5A, 5B and 5C illustrate an alternative embodiment of the present invention. FIGS. 5A, 5B and 5C are somewhat similar to a deflation mechanism described in Published U.S. Patent Application No. 2005/0028404, incorporated herein by reference in its entirety. However, along with other differences, deflation mechanism 502 includes a lever 508 having "up" and "down" positions such as that described in previous embodiments. Further, an apron 504 is provided in FIG. 5C to reduce the profile of deflation mechanism 502. Deflation mechanism 502 is an adjustable check valve, wherein the predetermined pressure at which the valve releases is adjustable.

In particular, deflation mechanism 502 includes a cap 506 and a base 512. Cap 506 is similar to cap 306 described above in that it has an upper cap piece 522 substantially similar to upper cap piece 322 previously described and a lower cap piece 524 substantially similar to lower cap piece 324 previously described. One variation in lower cap piece 324 and lower cap piece 524 of the present embodiment is that extended edge 324*c* is replaced herein with posts 544 which are discussed in further detail below.

Additionally, cap 506 includes an indicator mark 552 molded into upper cap piece 522 for aligning cap 506 with indicators formed in an adjacent apron 504 as illustrated in FIG. 5C. Also, as shown in FIG. 5A, lever 508 may include a pattern formed thereon, for example holes 554 or alternatively projections or additional materials printed thereon, which help a user grip lever 508.

In this embodiment, base 512 includes a seating 526 having an inlet 528 into which a one-way valve 534 is positioned. As with the previous embodiments, a flange 534*a* of one-way valve 534 forms a seal with seating 526. When the pressure within an inflatable bladder (not shown) reaches a predetermined pressure, flange 534*a* will lift off of seating 526 and air will be released from the inflatable bladder. Base 512 includes a sidewall 512*c*. Sidewall 512*c* includes two inclined tracks 542. Inclined tracks 542 engage posts 544 extending from an interior surface of cap 506. As cap 506 turns with respect to base 512, inclined tracks 542 move cap 506 towards and away from seating 526. A washer 548 contacts a crown 534*b* of one-way valve 534. A cylindrical protrusion 550 extends from an interior surface of cap 506.

To adjust the resistance of one-way valve 534, cap 506 is rotated via hinged lever 508. Posts 544 engage inclined tracks 542 and move cap 506 towards and away from seating 526, depending upon which direction cap 506 is rotated. When rotated in a first direction via lever 508, cap 506 moves towards seating 526. Cylindrical protrusion 550 contacts and applies pressure to washer 548, which in turn applies pressure to crown 534*b* of one-way valve 534. As pressure is applied to crown 534*b* of one-way valve 534, the pressure at which flange 534*a* lifts off of seating 526 is increased. Thus, inflatable bladder (not shown) will inflate to a higher pressure. Turning cap 506 in an opposite direction moves cap 506 in a direction away from seating 526 and lifts cylindrical protrusion 550 off washer 548, releasing the pressure on crown 534*b* of one-way valve 534. Thus, inflatable bladder will inflate to a lower pressure before flange 534*a* of one-way valve 534 lifts off of seating 526. As cap 506 turns, washer 548 does not twist or turn as ribs (not shown) on sidewall 512*c* of the base 512 engage a notch (not shown) in washer 548, ensuring that only a downward pressure is applied to one-way valve 534 to avoid one-way valve 534 twisting or turning and becoming unseated or damaged.

With respect to FIG. 5C, apron 504 includes ramped sides 504*b* which may include indicators, such as indicators 110 of FIGS. 1A and 1B. Indicators may include a scale of pressures to which inflatable bladder may be inflated to indicate to the wearer whether the pressure in inflatable bladder is increasing or decreasing as cap 506 is turned.

In another embodiment, various notches (not shown) in cap 506 may engage a protrusion (not shown) in base 512 or sidewall 512*c*, or vice versa, such that the wearer may feel the protrusion snap into the various notches to suggest a change in release pressure of the one-way valve 534. Such a feature would operate similar to protrusion 312*f* and notch 324*g* described above with respect to FIGS. 3A and 3B. In this embodiment, however, there may be several notches to show a range of release pressures.

FIGS. 6A-6F illustrate another embodiment of the present invention. FIG. 6A illustrates shoe 600 having an upper 603 and a sole 605. Shoe 600 also includes an inflatable bladder (not shown) and a deflation mechanism 602. Deflation mechanism 602 may be, for example, any of the deflation mechanisms described herein. Deflation mechanism 602 includes a cap 617. In order to obtain a low profile for cap 617, deflation mechanism 602 includes an apron 604. Rather than having a lever incorporated into cap 617, the embodiment of FIGS. 6A-6F incorporates a removable apron 604, as illustrated in FIGS. 6D-6F.

Apron 604 has a first end 604*a* which is coupled to a portion of upper 603 of shoe 600. In the present example, first end 604*a* of apron is hingedly connected to upper 603, for example at stitches 660. Alternatively, first end 604*a* may be hingedly connected to a plate (not shown) or other substrate affixed to an exterior surface of upper 603. Stitches 660 allow apron 604 to hinge away from cap 617. Alternatively, apron 604 may be attached to upper 603 via another hinged connection. For example, stitches 660 may be replaced with any type of metal or plastic hinge that may be apparent to one skilled in the art. Alternatively, apron 604 may be formed from a plate (not shown) that is incorporated into a portion of upper 603 and the hinged connection is formed where a apron 604 is formed from a thinner or weakened area of the plate that is flexible.

As illustrated in FIGS. 6E and 6F, once apron 604 is hingedly removed from around cap 617, cap 617 is accessible to a wearer's fingers for adjusting the maximum pressure within the inflatable bladder.

A second end 604*b* of apron 604 includes a male fastener 662. Male fastener 662 removably engages a female fastener 664 affixed to upper 603 of shoe 600, or, for example, to a plate or other substrate affixed to an exterior surface of upper 603, in one embodiment, the same surface to which first end 604*a* of apron 604 is fastened. As illustrated in FIGS. 6D-6F, cap 617 may be accessed by lifting apron and disengaging male fastener 662 from female fastener 662. In the examples shown in FIGS. 6A-6F, male and female fasteners 662/664 are illustrated as a snap fastener. In alternative embodiments, male and female fastener may be any type of fastener that provides temporary connection. For example, male and female fasteners may be hook and pile material, zipper, button, clasp or switch or any other type of fastener. Male and female fasteners 662/664 keep apron 604 flush against upper 603 when cap 617 is not being adjusted so that apron 604 and cap 617 keep a low profile to avoid damage to cap 617 during athletic activity.

Apron 604 hinges at first end 604*a* to provide access to turn cap 617 by grasping cap 617 along a textured side 666 of cap 617. Side 666 may be textured by including a high friction material, such as rubber or silicon, to an exterior side of cap 617. Alternatively, cap 617 may incorporate a lever (such as lever 108 illustrated in previous examples) to assist in turning cap 617.

As illustrated in FIGS. 6E and 6F, an indicator 668 may be provided on either an exterior surface of upper 603 adjacent cap 617 or on any plate (not shown) or other substrate provided that may be affixed to upper 603 adjacent cap 617.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. An article of footwear, comprising:

a deflation mechanism coupled to said article of footwear comprising a movable knob accessible from an exterior surface of said article of footwear, wherein said knob has a substantially low profile with respect to said exterior surface of said article of footwear;

and a lever rotatably coupled to said knob, wherein said lever has a first position in which said lever lays flat against said knob and a second position wherein said lever is positioned for a user to move said knob via said lever.

2. The article of footwear of claim 1, wherein said knob is surrounded by an apron having ramped sides to provide said low profile to said knob.

3. The article of footwear of claim 2, wherein said ramped sides of said apron include at least one indicator, wherein said indicator identifies the position of said knob.

4. The article of footwear of claim 1, wherein said knob is positioned on said article of footwear in a location selected from the group consisting of a sole and an upper.

5. The article of footwear of claim 1, wherein said lever is hingedly moveable from said first position to said second position.

6. The article of footwear of claim 1, further comprising:

an inflatable bladder; and an inflation mechanism fluidly connected to said inflatable bladder, wherein said deflation mechanism is connected to said inflatable bladder.

7. The article of footwear of claim 6, wherein said inflation mechanism is configured to be operated by downward pressure of a wearer's foot.

8. The article of footwear of claim 6, wherein said knob is a cap that is rotatable with respect to a base anchored to said inflatable bladder.

9. The article of footwear of claim 8, wherein said deflation mechanism includes a one-way valve forming a seal with said base that is released when pressure within said inflatable bladder reaches a predetermined pressure.

10. The article of footwear of claim 9, wherein said cap has:

a first position with respect to said base, wherein said seal between said one-way valve and said base is released when the pressure within said bladder reaches a predetermined pressure; and a second position with respect to said base, wherein said seal between said one-way valve and said base is removed.

11. The article of footwear of claim 9, wherein said cap has various positions with respect to said base, wherein at each of said cap positions the seal between said one-way valve and said base releases at a different pressure.

12. An article of footwear, comprising:

an inflatable bladder;

an inflation mechanism fluidly connected to said inflatable bladder; and a deflation mechanism fluidly connected to said inflatable bladder, said deflation mechanism having a cap and a base, wherein said cap is rotatable with respect to said base, wherein said cap includes a lever, said lever having a first position wherein said lever lays flat against an upper surface of said cap and a second position wherein said lever is positioned for a user to rotate said cap via said lever, and wherein said lever is hingedly moveable with respect to said cap and is moveable between said first and second positions.

13. The article of footwear of claim 12, wherein said deflation mechanism is surrounded by an apron having ramped sides to provide a low profile to said deflation mechanism.

14. The article of footwear of claim 13, wherein said ramped sides of said apron include at least one indicator, wherein said indicator identifies the position of said cap.

15. The article of footwear of claim 12, wherein said deflation mechanism is positioned on said article of footwear in a location selected from the group consisting of a sole and an upper.

* * * * *